US006062921A

United States Patent [19]

Möck et al.

[11] Patent Number: 6,062,921

[45] Date of Patent: May 16, 2000

[54] PROPULSION SYSTEM AND POWER PLANT FOR SHIPS OR BOATS AND PREFERABLY FOR NAVAL VESSELS

[75] Inventors: Günther Möck; Günther Goldthammer, both of Hamburg; Joachim Wahlers, Sauensiek; Knut Baumann, Hamburg, all of Germany

[73] Assignee: Blohm & Voss GmbH, Hamburg, Germany

[21] Appl. No.: 09/092,682

[22] Filed: Jun. 5, 1998

[30] Foreign Application Priority Data

Jun. 5, 1997 [DE] Germany ..... 197 23 611

[51] Int. Cl.[7] ..... B63H 21/20

[52] U.S. Cl. ..... 440/3; 440/38; 440/79

[58] Field of Search ..... 440/3, 4, 89, 79, 440/68, 38; 114/151

[56] References Cited

U.S. PATENT DOCUMENTS 806,083 11/1905 Gowing ..... 440/89
3,155,070 11/1964 Jebens et al. ..... 440/4
3,422,790 1/1969 Connell ..... 440/4
3,716,014 2/1973 Laucks et al. ..... 440/93
3,765,363 10/1973 Wald ..... 114/151
3,826,218 7/1974 Hiersig et al. ..... 440/3
4,344,760 8/1982 Kulikowski ..... 440/3
4,586,908 5/1986 Schlichthorst .

*Primary Examiner*—Sherman Basinger
*Attorney, Agent, or Firm*—Nils H. Ljungman & Associates

[57] ABSTRACT

A propulsion system and power plant for boats, preferably for naval vessels, consisting of two Diesel engines, a gas turbine and two drive shafts located next to one another with propellers, is characterized by the fact that there is also a water jet or hydrojet propulsion unit (1) between the two drive shafts (2, 3) which are located next to one another with propellers (4, 5), that the Diesel engines (6,7) are used to drive the two propellers (4, 5), that the water jet propulsion (1) is provided by the gas turbine (8) and that the gas turbine (8) is located between the Diesel engines (6, 7) and the stern of the vessel (9).

4 Claims, 3 Drawing Sheets

PROPULSION SYSTEM AND POWER PLANT FOR SHIPS OR BOATS AND PREFERABLY FOR NAVAL VESSELS

BACKGROUND OF THE INVENTION

1. Field of the Invention

This invention relates to a propulsion system for boats or ships, preferably for naval vessels, consisting of two Diesel engines, a gas turbine and two drive shafts located next to one another with propellers.

2. Background Information

On similar propulsion systems of the known art, the power of the gas turbine is transmitted to the two propellers by means of a corresponding transmission. In this known case, there are design limitations that require the gas turbine to be located forward of the Diesel engines, i.e. toward the bow of the vessel. But because the space in this area is urgently needed for other units, the object of the invention is to create a space-saving arrangement of all the mechanical equipment.

OBJECT OF THE INVENTION

The present invention teaches that this objective can be achieved by the additional provision of a water jet propulsion unit which is located between the two drive shafts which lie next to one another with propellers, by having the Diesel engines provide the propulsion for both propellers, by having the water jet propulsion take place by means of the gas turbine, and by locating the gas turbine between the Diesel engines and the stern of the vessel.

SUMMARY OF THE INVENTION

On one hand, the present invention makes it possible to free up an entire compartment, and on the other hand to realize the propellers so that they are significantly smaller, on account of the significantly reduced transmission of power.

As a result of the dependence of the propulsive power to be transmitted and the related propeller diameter with the corresponding shaft slope, the overall length (shaft length) of the propulsion unit can be reduced even further.

The overall propulsion system, which is shifted further into the after portion of the vessel (i.e., abaft or astern), further reduces the exposed length of the ship.

It is also possible to realize the exhaust duct via the stern, so that in the compartments, not only has the engine room been freed up, but the stack that lies over it on the top deck can also be eliminated.

As a result of the two propulsion systems which are independent of one another, there is also a further increase in redundancy.

In an additional configuration of the invention, there is a separate transmission for each Diesel engine propulsion unit.

In an additional advantageous configuration, the two transmissions can be coupled to one another by means of a connecting transmission.

The problem of the space requirement is of particular importance in naval vessels, because the space requirements regarding the weapons systems that have to be integrated have increased significantly in recent years. The requirement to save space in the upper-deck area has increased to the same extent. The propulsion systems, which in conventional naval vessels are located amidships, with the stack on the upper deck, do not leave room for the necessary additional space occupied by the weapons and electronics systems. Therefore the engine rooms have had to be displaced a whole compartment toward the stern, which also means that the exhaust duct has to be rerouted via the aftship or after portion of the vessel. The compartment thus saved, from the tank top to the upper deck, can be made available for weapons and electronic systems.

As mentioned above, in one configuration taught by the present invention, the geometric restrictions resulting from the propeller diameter and the shaft slope need only be taken into consideration for the output of the Diesel engines, which amounts to approximately 30–60% of the total output. The central unit with the gas turbine and the water jet propulsion is not limited to this geometry and can therefore be shifted toward the stern of the ship.

Moreover, the advantageous characteristics of the propeller and the water jet propulsion can be combined. Compared to a pure water jet variant which offers the same advantages in terms of space, the high efficiency of the propeller in the lower speed ranges can be retained. The same is true for the advantages of water jet propulsion in the upper speed ranges.

Because the two Diesel engine systems can be connected to one another by means of a connecting transmission, economical operation becomes possible, which means that the ship can be operated on one engine, at approximately 18–21 knots. The gas turbine system is preferably operated only in the upper speed range, although it can also be used by itself as the sole propulsion system for the ship.

The above discussed embodiments of the present invention will be described further hereinbelow with reference to the accompanying figures. When the word "invention" is used in this specification, the word "invention" includes "inventions", that is, the plural of "invention". By stating "invention", the Applicants do not in any way admit that the present application does not include more than one patentably and non-obviously distinct invention, and maintains that this application may include more than one patentably and non-obviously distinct invention. The Applicants hereby assert that the disclosure of this application may include more than one invention, and, in the event that there is more than one invention, that these inventions may be patentable and non-obvious one with respect to the other.

BRIEF DESCRIPTION OF THE DRAWINGS

The invention is explained in greater detail below with reference to the embodiments illustrated in the accompanying drawings, wherein.

DESCRIPTION OF THE PREFERRED EMBODIMENT

Figure 1:
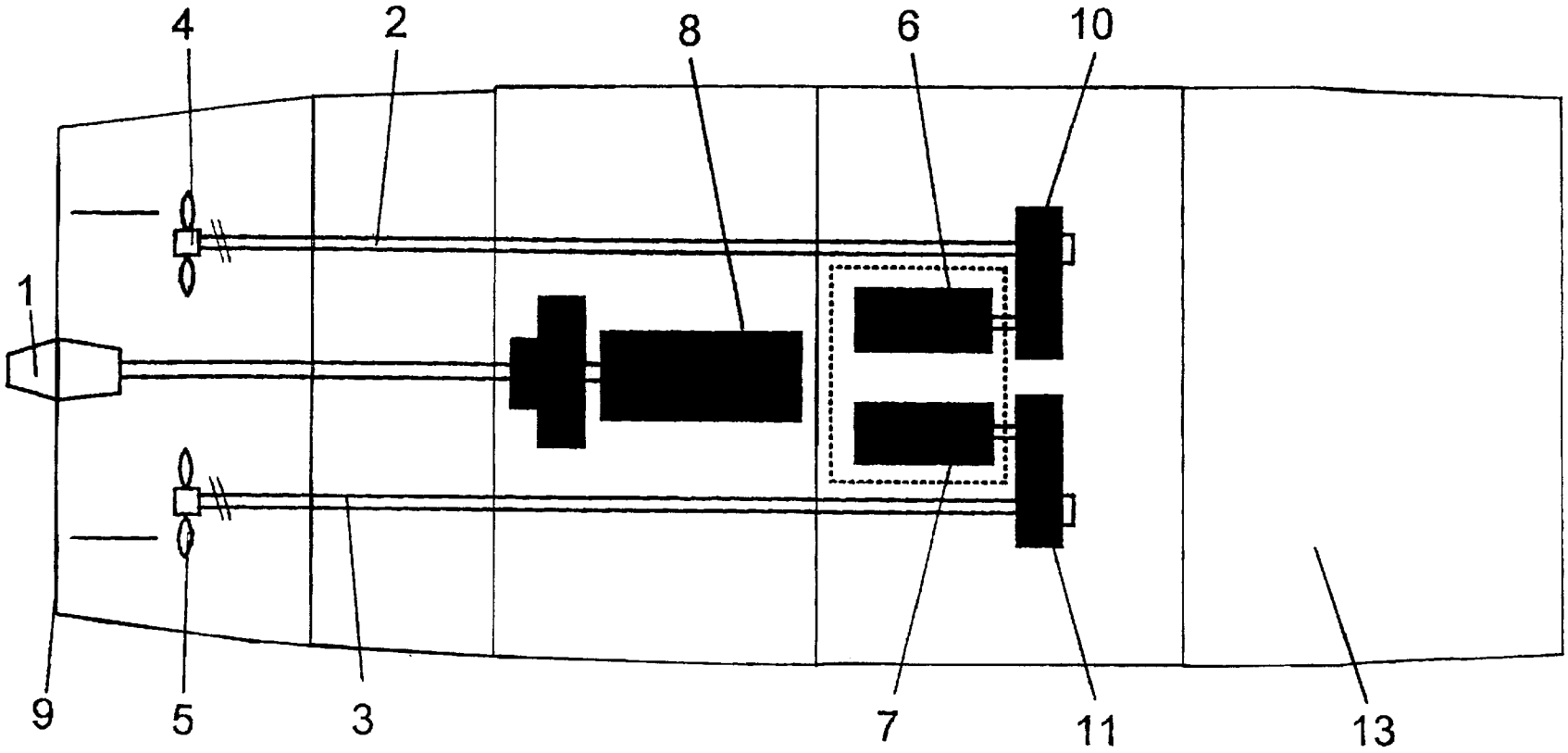
FIG. 1 shows an embodiment of the propulsion system in accordance with the present invention with two separate transmissions for the Diesel engines.
Figure 2:
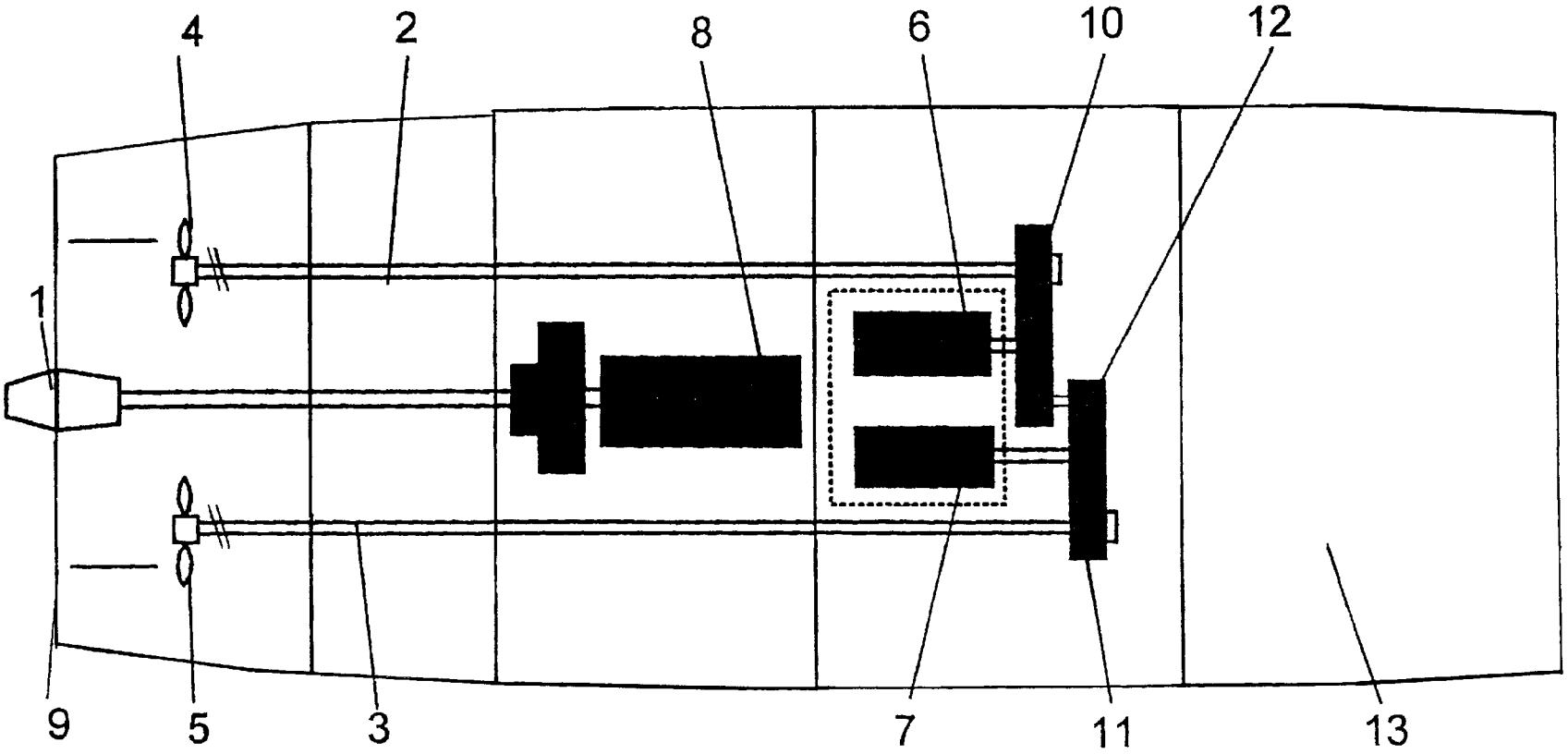
FIG. 2 shows an embodiment of the propulsion system in accordance with the present invention, in which the two transmissions for the Diesel engine propulsion can be coupled to one another by means of a connecting transmission.

The parts that are the same in the FIGS. 1 and 2, are identified by the same reference numbers. 1 is a water jet propulsion unit which is driven by means of the gas turbine 8. 2 and 3 are the drive shafts for the two propellers 4 and 5, which are driven by the Diesel engines 6 and 7 by means of the transmissions 10 and 11. 12 is the connecting transmission, by means of which the transmissions 10 and 11 can be coupled to one another.

As a result of the location of the gas turbine 8 between the Diesel engines 6 and 7 and the stern 9, on one hand the exhaust gases can be exhausted via the stern 9, which results in a significant reduction of the infrared signature, and on the other hand the compartment 13 becomes available for other purposes which, on naval vessels, means space for new weapons configurations.

Figure 3:
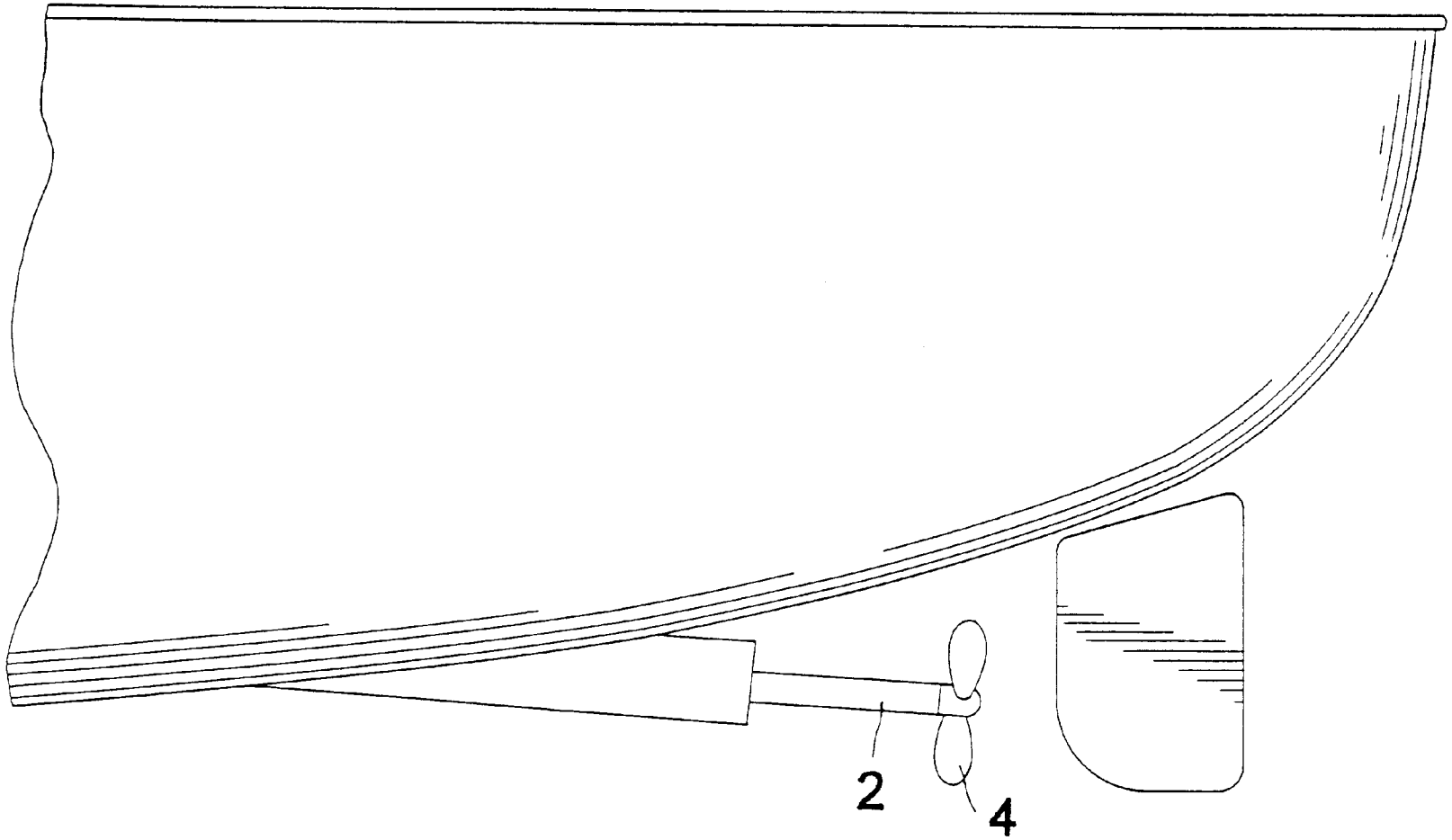
FIG. 3 shows a ship which could possibly utilize the present invention.

FIG. 3, shows a ship in which the present invention could be installed, parts that are the same or similar as those in FIGS. 1 and 2 are identified by the same reference numbers.

One feature of the invention resides broadly in the propulsion system or power plant for boats or ships, preferably for naval vessels, consisting of two Diesel engines, a gas turbine and two drive shafts located next to one another with propellers, characterized by the fact that there is also a water jet or hydrojet propulsion unit 1 between the two drive shafts 2, 3 which are located next to one another with propellers 4, 5, that the Diesel engines 6, 7 are used to drive the two propellers 4, 5, that the water jet propulsion 1 is provided by the gas turbine 8 and that the gas turbine 8 is located between the Diesel engines 6, 7 and the stern 9 of the vessel.

Another feature of the invention resides broadly in the propulsion system characterized by the fact that there is a separate transmission 10, 11 for each Diesel engine drive.

Yet another feature of the invention resides broadly in the propulsion system characterized by the fact that the two transmissions 10, 11 can be coupled to one another by means of a connecting transmission.

Moreover, the advantageous characteristics of the propeller and the water jet propulsion can be combined. Compared to a pure water jet variant which offers the same advantages in terms of space, the high efficiency of the propeller in the lower speed ranges can be retained. The same is true for the advantages of water jet propulsion in the upper speed ranges. In at least one embodiment of the present invention, this combination can result in not only the added efficiency, but also allows the possibility of one or both of the propeller and/or water jet propulsion systems to be reduced in size and power.

Further, in at least one embodiment of the present invention, the two diesel engines 6, 7 can be of significantly different sizes or power, allowing a smaller and/or less powerful engine to be used for low speeds and a larger and/or more powerful engine to be used, alone or in combination with the other smaller engine, at high speeds. In at least one embodiment, the connecting transmission 12 can allow the ship to continue to function even upon the occurrence of the failure of one of the two diesel engines 6, 7.

The components disclosed in the various publications, disclosed or incorporated by reference herein, may be used in the embodiments of the present invention, as well as, equivalents thereof.

The appended drawings in their entirety, including all dimensions, proportions and/or shapes in at least one embodiment of the invention, are accurate and to scale and are hereby included by reference into this specification.

All, or substantially all, of the components and methods of the various embodiments may be used with at least one embodiment or all of the embodiments, if more than one embodiment is described herein.

Although only a few exemplary embodiments of this inventions have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims.

The invention as described hereinabove in the context of the preferred embodiments is not to be taken as limited to all of the provided details thereof, since modifications and variations thereof may be made without departing from the spirit and scope of the invention.

What is claimed is:

1. A propulsion system for naval vessels, the naval vessels comprising ships, said propulsion system comprising:

a first diesel engine and a second diesel engine;

a gas turbine;

a first drive shaft and a second drive shaft;

said first drive shaft being operatively connected to said first diesel engine;

said second drive shaft being operatively connected to said second diesel engine;

a first propeller and a second propeller;

said first propeller being connected to said first drive shaft;

said second propeller being connected to said second drive shaft;

said first and second drive shafts being disposed adjacent one another;

a water jet propulsion unit disposed between said first and said second drive shafts;

said first diesel engine being configured to drive said first propeller;

said second diesel engine being configured to drive said second propeller;

said gas turbine being configured to power said water jet propulsion unit; and said gas turbine being disposed between said first and second diesel engines and the stern of said vessel.

2. The propulsion system according to claim 1 comprising:

a first transmission and a second transmission;

said first transmission being configured and disposed to operatively engage said first drive shaft and said first diesel engine;

said second transmission being configured and disposed to operatively engage said second drive shaft and said second diesel engine.

3. The propulsion system according to claim 2, comprising:

a connecting transmission; and said connecting transmission being configured and disposed to couple said first transmission with said second transmission to permit at least one of: said first diesel engine to power said second propeller and said second diesel engine to power said first propeller.

4. The propulsion system according to claim 3, wherein:

said propulsion system is configured to be disposed in a back portion of a ship.

* * * * *